US011311902B2

(12) United States Patent
Otsuki et al.

(10) Patent No.: US 11,311,902 B2
(45) Date of Patent: Apr. 26, 2022

(54) VISCOUS MATERIAL WIPING DEVICE

(71) Applicant: KAWASAKI JUKOGYO KABUSHIKI KAISHA, Kobe (JP)

(72) Inventors: Naohiro Otsuki, Kakamigahara (JP); Satoshi Suzuki, Kakamigahara (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 69 days.

(21) Appl. No.: 16/810,862

(22) Filed: Mar. 6, 2020

(65) Prior Publication Data

US 2020/0206772 A1 Jul. 2, 2020

Related U.S. Application Data

(63) Continuation of application No. PCT/JP2018/032666, filed on Sep. 3, 2018.

(30) Foreign Application Priority Data

Sep. 6, 2017 (JP) ..... JP2017-170838

(51) Int. Cl.
*B05C 11/02* (2006.01)
*B05C 11/10* (2006.01)

(52) U.S. Cl.
CPC ..... *B05C 11/023* (2013.01); *B05C 11/10* (2013.01)

(58) Field of Classification Search
USPC ..... 118/302; 347/22, 31
See application file for complete search history.

(56) References Cited

U.S. PATENT DOCUMENTS

2007/0195122 A1* 8/2007 Hiruma ..... B41J 2/16511 347/29
2017/0021394 A1* 1/2017 Ohno ..... B32B 38/18
2018/0264822 A1* 9/2018 Tanioku ..... B41J 2/16541
2019/0256314 A1* 8/2019 Sato ..... B65H 19/1852
2019/0366721 A1* 12/2019 Ohkura ..... B41J 2/16535

FOREIGN PATENT DOCUMENTS

JP 06-269720 A 9/1994

OTHER PUBLICATIONS

English translation JP-06-269720. (Year: 1994).*

* cited by examiner

*Primary Examiner* — Yewebdar T Tadesse
(74) *Attorney, Agent, or Firm* — Xsensus LLP

(57) ABSTRACT

A viscous material wiping device wipes the viscous material attached to the tip of a spatula with a sheet. A sheet support jig has a groove recessed in the sheet facing surface, the groove includes a receiving portion and a wiping portion that are continuous in the groove extending direction, and the wiping portion has a groove width smaller than that of the receiving portion and substantially equal to the outer dimension of the tip of the spatula. A controller drives the moving mechanism to position the spatula on the opposite side of the sheet supporting jig with respect to the sheet in a posture that the spatula extends parallel to the groove extending direction and overlaps the groove when viewed in a normal direction of the sheet facing surface, and move the spatula in the normal direction so that the tip of the spatula is received in the receiving portion by pressing the sheet against the groove with the spatula. The spatula is configured to move in the groove extending direction so that the tip of the spatula passes through the wiping portion.

20 Claims, 7 Drawing Sheets

VISCOUS MATERIAL WIPING DEVICE

CROSS-REFERENCES TO RELATED APPLICATIONS

The present application is a bypass continuation of PCT Application No. PCT/JP2018/032666, filed Sep. 3, 2018, which claims priority to JP 2017-170838, filed Sep. 6, 2017, both of which are incorporated herein by reference.

TECHNICAL FIELD

The present invention relates to a device for wiping a viscous material such as a sealant or an adhesive with a sheet.

BACKGROUND

At the manufacturing site of vehicles and industrial machinery, automation of applying a viscous material to the joint of two parts is underway. For example, there is a viscous material coating device that can be applied to an automobile manufacturing site. This device includes a mixing head that is attached to a robot hand and discharges a sealant while moving along a predetermined locus.

SUMMARY OF INVENTION

A viscous material wiping device according to an aspect of the present invention is a viscous material wiping device for wiping a viscous material attached to a tip of a spatula with a sheet, the device including: a sheet support jig having a sheet facing surface facing the sheet; a spatula holding member that holds a base end portion of the spatula and cantilever-supports the spatula; a moving mechanism for moving the spatula holding member together with the spatula; and a controller, in which the sheet support jig has a groove recessed in the sheet facing surface, the groove includes a receiving portion and a wiping portion continuous in a groove extending direction, and the wiping portion has a groove width smaller than that of the receiving portion and substantially equal to an outer dimension of the tip of the spatula, and the controller is configured to drive the moving mechanism so as to position the spatula on the opposite side of the sheet supporting jig with respect to the sheet, in a posture that the spatula extends parallel to the groove extending direction and overlaps the groove when viewed in a normal direction of the sheet facing surface, move the spatula in the normal direction so that the tip of the spatula is received in the receiving portion by pressing the sheet against the groove with the spatula, and move the spatula in the groove extending direction so that the tip of the spatula passes through the wiping portion.

According to the above configuration, after the tip of the spatula to which the viscous material is attached is received in the receiving portion having a relatively large groove width, the spatula moves within the groove and passes through the wiping portion having a groove width substantially equal to the outer dimension of the tip. When the spatula is moved in the normal direction and received in the groove, the sheet is pressed with the spatula and is fitted into the groove so as to sandwich both sides of the spatula. Therefore, when passing through the wiping portion, the viscous material attached to the tip of the spatula can be wiped with the sheet. Since this operation is automated by the control device and the moving mechanism, labor of the wiping of the viscous material can be saved.

DESCRIPTION OF EMBODIMENTS

Figure 1A:
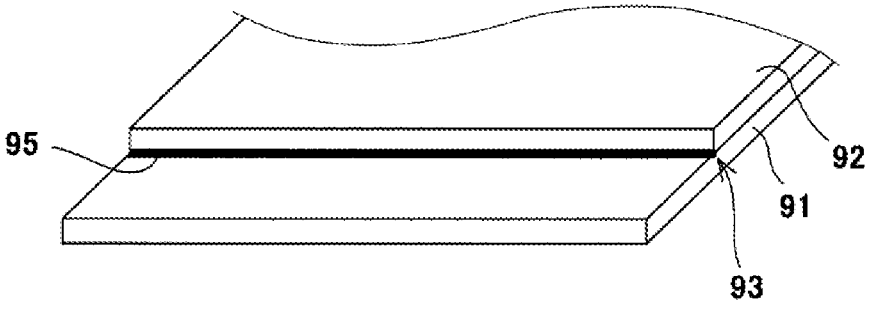
FIG. 1A is a view showing a viscous material applied to a workpiece.

Hereinafter, embodiments will be described with reference to the drawings. Throughout the drawings, the same or corresponding elements are denoted by the same reference numerals, and repeated description is omitted.

<Application and Shaping>

Figure 1B:
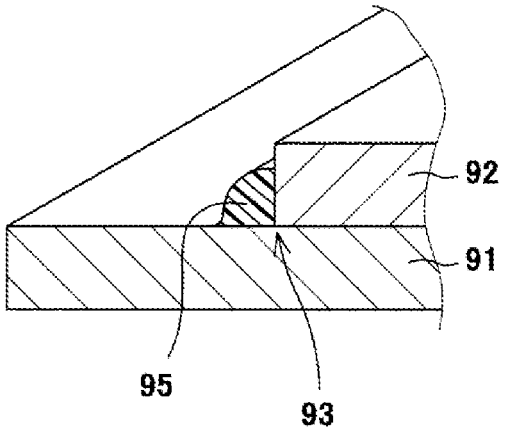
FIG. 1B is a view showing a cross section of the viscous material before shaping.
Figure 1C:
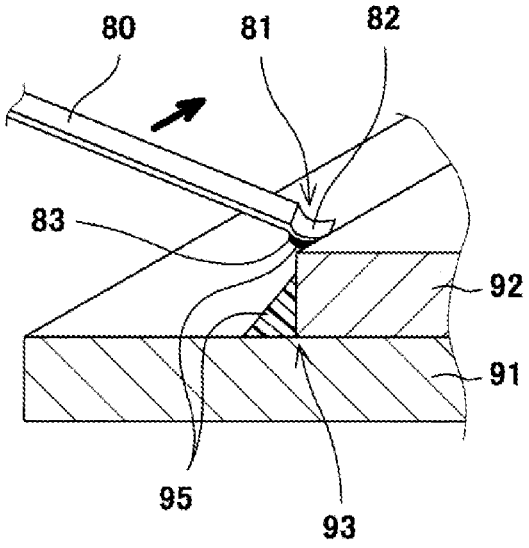
FIG. 1C is a view showing a cross section of the viscous material during shaping.

FIGS. 1A to 1C show a manufacturing site to which a viscous material wiping device according to an embodiment (hereinafter simply referred to as "wiping device 1") is applied. In this manufacturing site, a viscous material 95 is applied to a mating portion 93 of workpieces 91 and 92 formed by overlapping or butting the two workpieces 91 and 92. In addition to the mating portion 93, it may be applied to an opening edge portion formed in the workpiece.

As an example of a manufacturing site, a manufacturing site of a vehicle (for example, an aircraft or an automobile) and an industrial machine (for example, a construction machine, an agricultural machine, or a machine tool) can be utilized. In the present embodiment, as an example, the workpieces 91 and 92 are plate-shaped, and the mating portion 93 is formed by overlapping the workpieces 91 and 92. The mating portion 93 includes the surface of the first workpiece 91 and the side end face of the second workpiece 92, forms a right angle, and extends along the side end face of the second workpiece 92. In an aircraft manufacturing site, the workpieces 91 and 92 may be segments of a cylindrical airframe. The viscous material 95 is a material having viscosity such as a sealant or an adhesive. As an example, the viscous material 95 has a viscosity of 1000 to 2000 Pa•s in a normal temperature environment. A normal temperature environment can be, for example, 59° F. to 77° F., 80° F. plus or minus 5° F., or plus or minus 10° F., or 70 degrees plus or minus 2° F., plus or minus 5° F., or , or plus or minus 10° F.

As shown in FIG. 1A, the viscous material 95 is applied along the extending direction of the mating portion 93 as an example. This application is performed manually or by an industrial robot. The applied viscous material 95 extends in a bead shape. As shown in FIG. 1B, the viscous material 95 is provided so as to straddle the surface of the first workpiece 91 and the side end face of the second workpiece 92, and the surface of the viscous material is rounded.

As shown in FIG. 1C, a shaping of the surface of the applied viscous material 95 with a spatula 80 is performed incidentally or subsequently to the application. This shaping is performed manually or by an industrial robot. If it is automated by an industrial robot, it is beneficial because a shaping and a wiping described later can be performed continuously. In the shaping, the tip 81 of the spatula 80 contacts the surface of the viscous material 95, and the tip 81 of the spatula 80 is slid on the surface in the bead extending direction of the viscous material 95. The surface of the viscous material 95 is smoothed, and the cross section of the viscous material 95 is shaped into a triangular shape.

<Spatula>

Figure 2A:
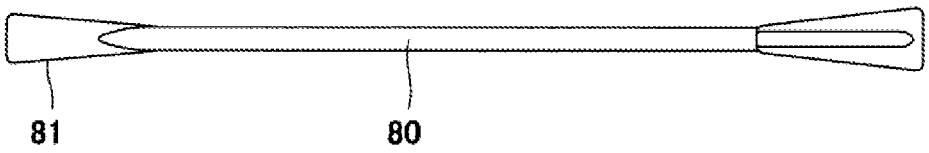
FIG. 2A is an overall front view of a spatula.
Figure 2B:
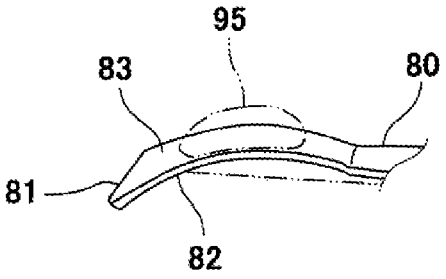
FIG. 2B is a front view of the tip of the spatula.
Figure 2C:
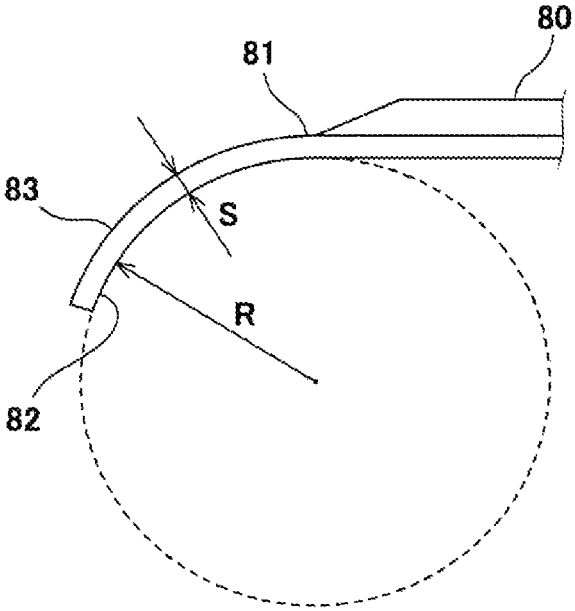
FIG. 2C is a side view of the tip of the spatula.

FIG. 2A is an overall plan view of the spatula 80, FIG. 2B is a plan view of the tip 81 of the spatula 80, and FIG. 2C is a side view of the tip 81 of the spatula 80. As shown in FIG. 2A, the spatula 80 is formed in a long rod shape or shaft shape as a whole.

As shown in FIGS. 2B and 2C, the tip 81 of the spatula 80 includes a curved plate shape, in other words, a spoon shape. As an example, the tip 81 has a shape in which a flat plate is curved with a substantially constant curvature, and is curved in a substantially arc shape in a side view. As an example, the arc of the tip 81 in a side view is in the range of ⅛ arc of a circle to ¼ arc or a circle, although other amounts of arc are possible. The tip 81 of the spatula 80 has a concave surface 82 and a convex surface 83 on the opposite side thereof. The tip 81 has a plate thickness s, the concave surface 82 is a curved surface with a radius R, the convex surface 83 is a curved surface with an outer radius R +s, an inner radius R, and the concave surface 82 is substantially concentric with the convex surface 83. Since the curvature of the tip 81 is substantially constant, the concave surface 82 and the convex surface 83 may be implemented as cylindrical surfaces. The shaping is performed by sliding the convex surface 83 on the viscous material 95.

Along with the application, every time the shaping is performed (once or multiple times), the wiping of the viscous material 95 attached to the tip 81 (particularly, the convex surface 83) of the spatula 80 with the sheet 96 is performed. The wiping device 1 (see FIG. 3) automates the wiping, and thereby, labor saving of the wiping, which is incidental to the application, is achieved.

<Wiping Device: Sheet Supply Mechanism>

Figure 3:
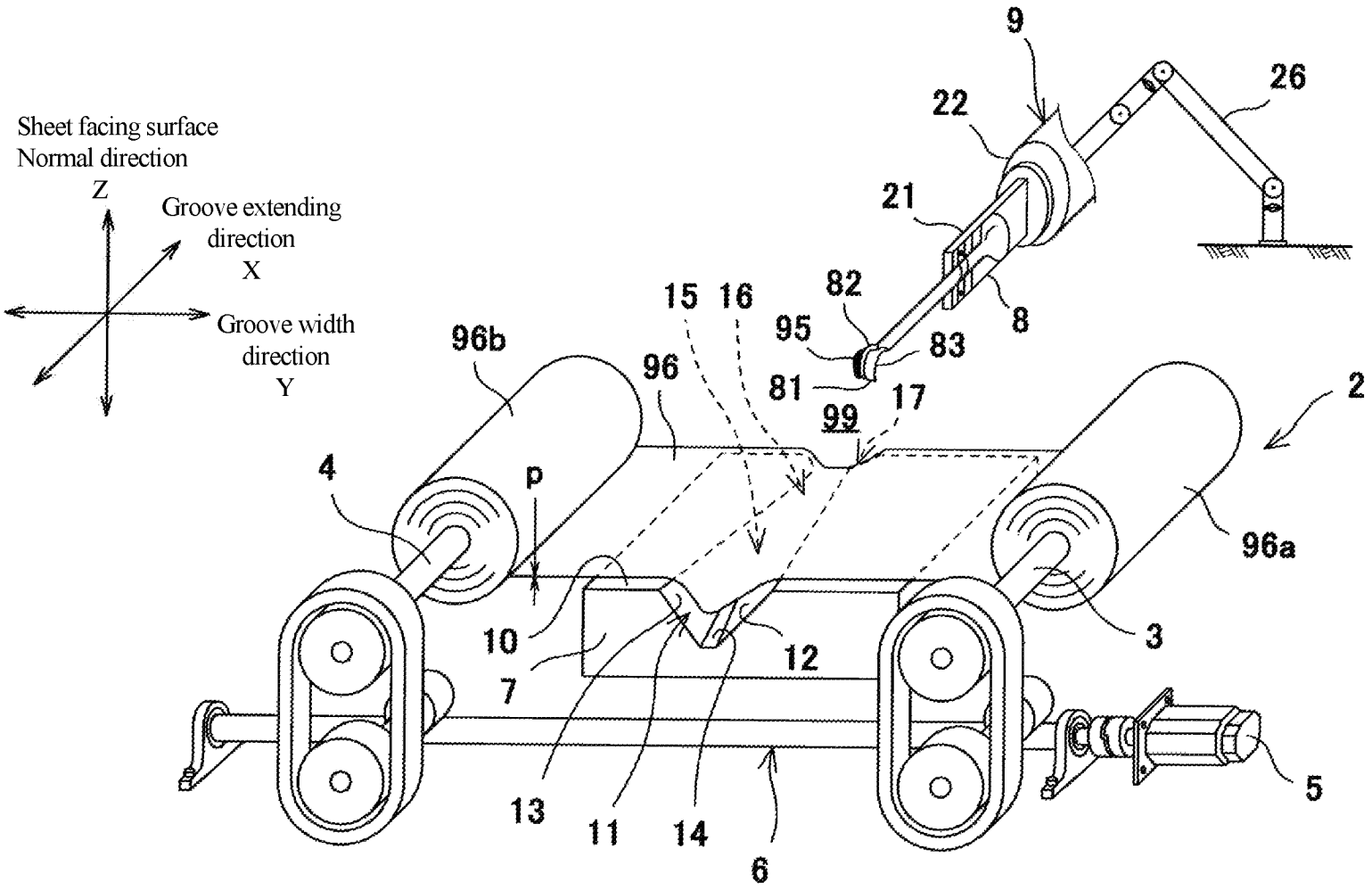
FIG. 3 is a conceptual diagram showing a viscous material wiping device according to an embodiment, and is a diagram showing a process of positioning the spatula on the opposite side of a sheet support jig with respect to a sheet.

FIG. 3 is a conceptual diagram showing the wiping device 1. The sheet 96 used in the wiping device 1 is paper or cloth (including woven fabric and non-woven fabric), and may be dry or wet. The thickness p of the sheet 96 is approximately 40 to 300 μm, although other thicknesses are possible. The wiping device 1 includes a sheet supply mechanism 2 and automates the supply of a clean sheet 96 before wiping and the discharge of the sheet 96 with the viscous material 95 by wiping.

The sheet supply mechanism 2 includes a feed roller 3, a take-up roller 4, a roller actuator 5, and a power transmission mechanism 6. The two rollers 3 and 4 extend in parallel and are separated from each other. The feed roller 3 supports an upstream roll 96*a* around which the sheet 96 before wiping is wound. The take-up roller 4 supports a downstream roll 96*b* around which the sheet 96 after wiping is wound. A work area 99 where the viscous material 95 is wiped off is formed between the two rollers 3 and 4. In the work area 99, the sheet 96 extends in a common circumscribed line direction of the two rolls 96*a* and 96*b*, and the two rolls 96*a* and 96*b* are composed of one long sheet 96. In the work area 99, no tension is applied to the sheet 96, and the sheet 96 is slightly loosened. The roller actuator 5 is a power source for the two rollers 3 and 4 and includes a single electric motor as an example, although more than one motor may be used, if desired. The power transmission mechanism 6 transmits the power generated by the roller actuator 5 to the two rollers 3 and 4 and rotationally drives the two rollers 3 and 4 in the same direction. The power transmission mechanism 6 may have any desired structure, and an exemplary implementation is described below.

When the roller actuator 5 is actuated, the sheet 96 travels from the upstream roll 96*a* to the downstream roll 96*b*. Specifically, the feed roller 3 rotates, and the clean sheet 96 is pulled out from the outer peripheral surface of the upstream roll 96*a* and supplied to the work area 99. The take-up roller 4 also rotates, and the sheet 96 with the viscous material 95 located in the work area 99 is wound around the downstream roll 96*b* to form the downstream roll 96*b*.

However, the roller actuator 5 may include two electric motors corresponding to the feed roller 3 and the take-up roller 4, respectively. In the illustrated example, a pair of belt transmission mechanisms are employed as the power transmission mechanism 6, the rotation of the roller actuator 5 is input to a driving pulley, and a driven pulley outputs the rotation to the roller 3 or the roller 4. The roller actuator 5 may be omitted, and a lever may be connected to the driving pulley. In this case, when a worker on the manufacturing site manually rotates the lever, the rollers 3 and 4 are rotationally driven, and the sheet 96 is supplied to and discharged from the work area.

<Wiping Device: Sheet Support Jig>

The wiping device 1 includes a sheet support jig 7, a spatula holding member 8, and a moving mechanism 9. The sheet support jig 7 is disposed in the work area 99. The sheet support jig 7 has a sheet facing surface 10 that faces the sheet 96 in the work area 99.

In the present embodiment, the sheet support jig 7 is formed of an elastic body such as rubber. The sheet support jig 7 forms a hexahedron such as a rectangular parallelepiped, and the sheet facing surface 10 has a square or rectangular shape. The sheet facing surface 10 is horizontal, and the normal direction Z of the sheet facing surface 10 is vertical. The sheet facing surface 10 forms the upper surface of the sheet supporting jig 7, and the four surfaces that intersect the sheet facing surface 10 form the side surfaces of the sheet supporting jig 7. The sheet facing surface 10 is positioned below the sheet 96 in the work area 99.

The sheet support jig 7 has a groove 11 recessed in the sheet facing surface 10. The groove 11 extends in a straight line on the sheet facing surface 10 and width of the groove varies. The groove 11 is formed by a pair of inner side surfaces 12 and 13 and a bottom surface 14. The facing distance between the inner side surfaces 12 and 13 is the groove width.

The groove 11 includes a receiving portion 15, a wiping portion 16, and a relief portion 17 that are continuous in a groove extending direction X. The wiping portion 16 has a smaller groove width than that of the receiving portion 15, and the relief portion 17 has a larger groove width than that of the wiping portion 16. The width direction of the groove 11 (hereinafter, "groove width direction Y") is a direction orthogonal to the groove extending direction X in the sheet facing surface 10 and is also orthogonal to the normal direction Z.

In the present embodiment, the groove extending direction X is parallel to one side of the sheet facing surface 10. The groove 11 reaches the edge of the sheet facing surface 10 at both ends in the groove extending direction X, and is also open to the two side surfaces of the sheet supporting jig 7.

Figure 4A:
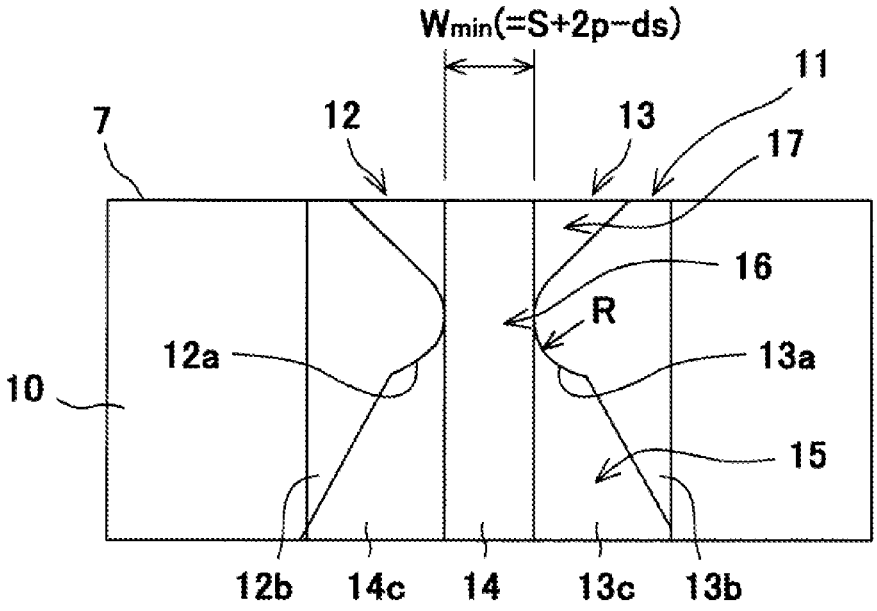
FIG. 4A is a plan view of the sheet support jig.
Figure 4B:
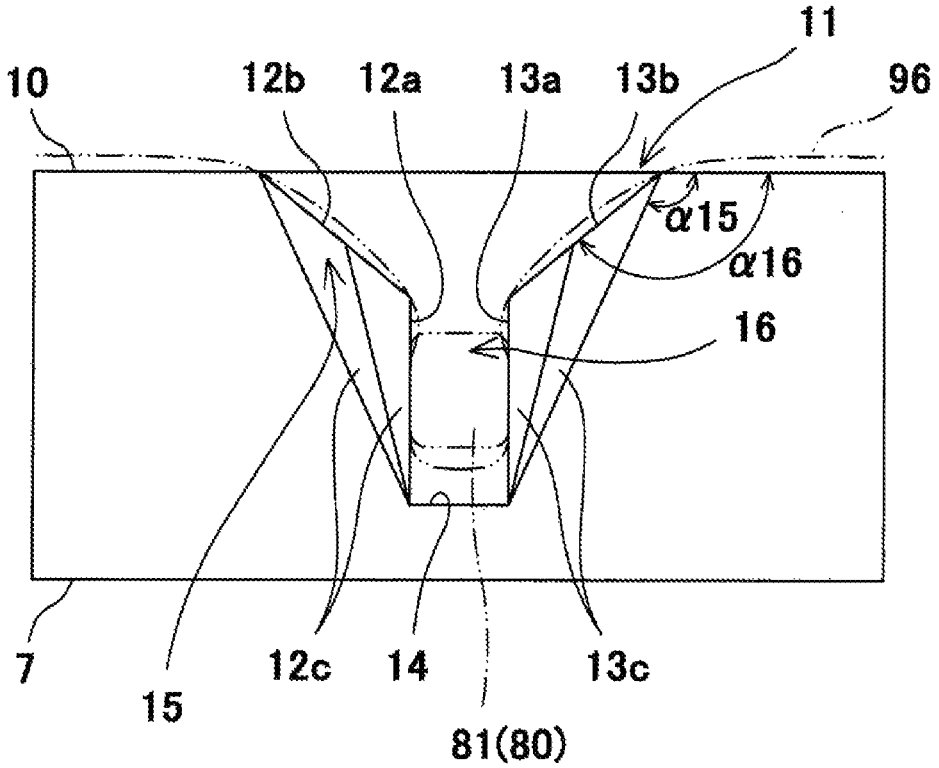
FIG. 4B is a front view of the sheet support jig.

FIG. 4A is a plan view of the sheet support jig 7, and FIG. 4B is a front view of the sheet support jig 7. In the present embodiment, the inner side surfaces 12 and 13 of the groove 11 are formed symmetrically with respect to the groove width center. The inner side surfaces 12 and 13 form curved inner side surfaces 12*a* and 13*a* that are curved with substantially the same curvature as the concave surface 82 of the spatula 80 when viewed in the normal direction Z at the portion where the wiping portion 16 is formed. The curved inner side surfaces 12*a* and 13*a* have an arc shape that protrudes inward each other in the groove width direction Y.

More specifically, the groove width Wmin of the portion where the wiping portion 16 is disposed is smaller by a minute amount ds than the sum of the plate thickness S of the tip 81 of the spatula 80 and the thickness 2p of two sheets (Wmin=S+2p−ds). If the minute amount ds is subtracted from the thickness 2p of two sheets, the value becomes substantially zero, so the groove width Wmin is substantially equal to the plate thickness S as an example of the outer dimension. Thus, according to one implementation, ds is equal to 2p. Further, ds can vary from 2p by any desired amount, and can be, for example, great than 2p by at least 1%, at least 2%, at least 5%, at least 10%, or more.

The inner side surfaces 12 and 13 are inclined so that an angle formed with the sheet facing surface 10 forms an obtuse angle. In the receiving portion 15, the inner side surfaces 12 and 13 extend from the sheet facing surface 10 inclined inward in the groove width direction X with respect to the groove depth direction and intersect the bottom surface 14. The wiping portion 16 is similarly inclined, but an angle α16 formed between the inner side surfaces 12 and 13 and the sheet facing surface 10 at the wiping portion 16 is greater than an angle α15 formed between the inner side surfaces 12 and 13 and the sheet facing surface 10 at the receiving portion 15. For this reason, in the wiping portion 16, the inner side surface 12 has a first portion 12*b* forming an angle with the sheet facing surface 10 and a second portion 12*c* continuous from the first portion, extending more steeply than the first portion, and forming an angle with the bottom surface 14. The length of the first portion 12*b* increases from the receiving portion 15 toward the wiping portion 16 in the groove extending direction X. The inclination of the second portion 12*c* becomes tighter from the receiving portion 15 toward the wiping portion 16 in the groove extending direction X. From the above, the groove width becomes narrower from the receiving portion 15 toward the wiping portion 16 in the groove extending direction X.

<Wiping Device: Spatula Holding Member, Moving Mechanism>

The spatula holder or holding member 8 includes a holding portion 21 that holds the base end portion of the spatula 80 and an attachment portion 22 that is detachably attached to a mover or moving mechanism 9. The moving mechanism 9 moves the spatula holding member 8 and the spatula 80 held by the spatula holding member 8. As an example, the moving mechanism 9 includes a vertical articulated robot or other type of robot, and includes a robot arm 26 having a plurality of (for example, six) joints, and a plurality (the same number of joints) of moving actuators 27 (see FIG. 5) that respectively drive the plurality of joints. The moving actuators 27 may be implemented by, for example, electric motors. When the moving mechanism 9 includes a vertical articulated robot, the attachment portion 22 of the spatula holding member 8 is detachably attached to the tip of the robot arm 26. When the robot arm 26 of the moving mechanism 9 is operated, the spatula holding member 8 and the spatula 80 held by the spatula holding member move.

<Wiping Device: Controller>

Figure 5:
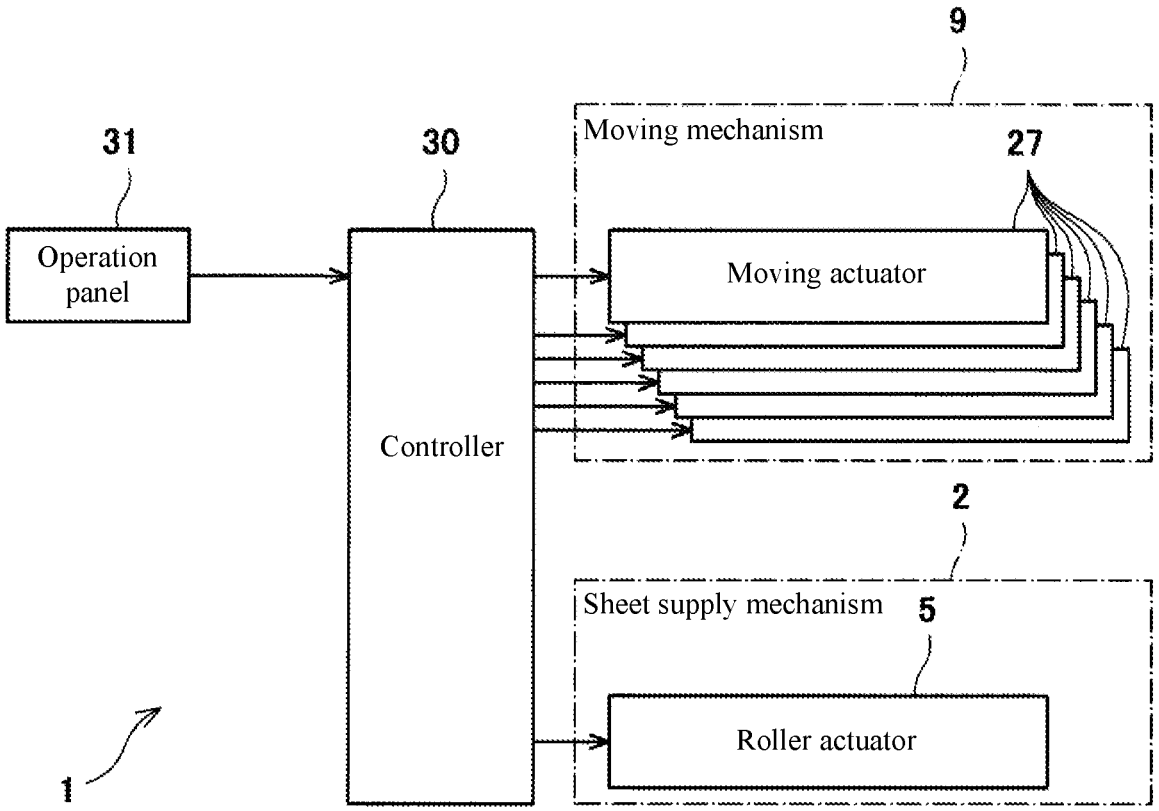
FIG. 5 is a block diagram showing the viscous material wiping device according to an embodiment.
Figures 6A, 6B, 6C:
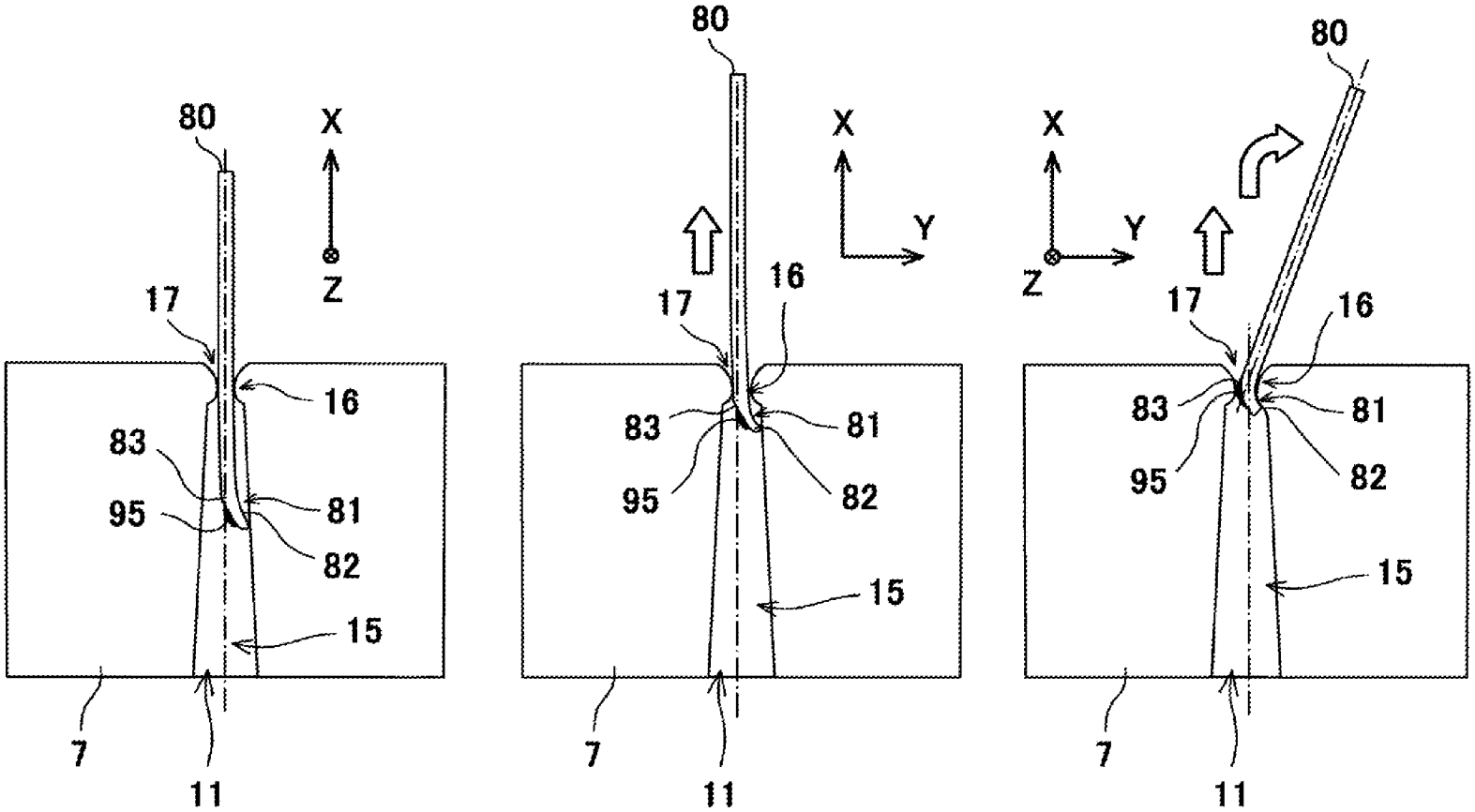
FIG. 6A is a diagram showing a process of receiving the tip of the spatula in a receiving portion.
FIG. 6B is a diagram showing a process of moving the spatula in a groove extending direction.
FIG. 6C is a diagram showing a process of moving the spatula in the groove extending direction while rotationally moving the spatula.

As shown in FIG. 5, the roller actuator 5 of the sheet supply mechanism 2 and the moving actuator 27 of the moving mechanism 9 are controlled by a controller 30. The controller 30 is, for example, a computer having a memory such as ROM and RAM and a CPU, and a program stored in the ROM is executed by the CPU. The controller 30 may be a single device or may be divided into a plurality of devices.

In the present embodiment, the program stored in the ROM includes a program that controls a moving locus and a moving speed of the tip of the robot arm 26, and by execution of the program (that is, playback), the spatula holding member 8 and the held spatula 80 can be moved as previously taught.

The controller 30 is connected to an operation panel 31. The operation panel 31 is operated by a worker on the manufacturing site. When a command to start wiping is input on the operation panel 31 by the worker, the CPU of the controller 30 executes the above-described program, and position control and movement control of the spatula 80 are performed. Alternatively, the start of the wiping can be triggered by a timer, a sensor which senses a buildup on the tip 80 of the spatula 81, or be triggered by any desired trigger or combination of triggers.

The functionality of the elements disclosed herein including but not limited to the controller 30 may be implemented using circuitry or processing circuitry which includes general purpose processors, special purpose processors, integrated circuits, ASICs ("Application Specific Integrated Circuits"), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

<Wiping>

The wiping using the wiping device 1 having the above-described configuration starts when the command is input by the worker on the operation panel 31, or by the other movement triggers, described above. The operation of the actuator described below is based on the control of the controller 30. When the command is input, one or more of the moving actuators 27 are actuated, and the posture of the robot arm 26 and the position and posture of the spatula 80 are changed.

As a result, the spatula 80 is positioned on the opposite side of the sheet support jig 7 with respect to the sheet 96 in a posture that extends parallel to the groove extending direction X and overlaps the groove 11 when viewed in the normal direction of the sheet facing surface 10. In this embodiment, since the normal direction Z is vertical and the sheet support jig 7 is positioned below the sheet 96, the spatula 80 is positioned above the sheet 96. The "posture extending in parallel with the groove extending direction X when viewed in the normal direction" includes not only a posture in which the tip 81 of the spatula 80 extends in the sheet facing surface 10 (as an example, extending horizontally), but also a posture in which it is inclined in the normal direction Z (as an example, inclined up or down).

Next, the spatula 80 is moved to the side in which the spatula 80 approaches the sheet support jig 7 in the normal direction Z, the sheet 96 is pressed against the groove 11 with the spatula 80, and the tip 81 of the spatula 80 is received in the receiving portion. At this time, the concave surface 82 of the spatula 80 is in a posture facing one of the pair of inner side surfaces 12 and 13. In addition, the convex surface 83 of the spatula 80 is moved to a position facing the other of the pair of inner side surfaces 12 and 13.

When the spatula 80 is received in the receiving portion 15, the sheet 96 is also pressed against the groove 11 together, and the sheet 96 is deformed into a substantially V shape. The tip 81 of the spatula is positioned inside the sheet 96 deformed into the V shape and is sandwiched between different portions of the sheet 96. Since the sheet 96 in the work area 99 is not tensioned and has a slight slack, even if it is made of paper, the sheet 96 is received in the groove 11 together with the spatula 80 without being torn. Further, since the inner side surfaces 12 and 13 of the groove 11 are inclined so that the angle formed with the sheet facing surface 10 is an obtuse angle, the sheet 96 can be prevented from being cut at an angle formed by the inner side surface and the sheet facing surface 10. In particular, in the wiping portion, the angle formed by the sheet facing surface 10 and the inner side surfaces 12 and 13 is relatively large, and the sheet 96 is particularly difficult to tear.

After the spatula 80 is received in the receiving portion, the spatula 80 is moved in the groove extending direction X. Thereby, the tip 81 of the spatula 80 approaches the wiping portion. Since the groove width gradually decreases, the convex surface 83 of the spatula 80 is brought close to and rubs the sheet 96, and the viscous material 95 adhering on the convex surface 83 is wiped by the sheet 96 and removed from the spatula 80.

The moving mechanism 9 allows the spatula 80 to pass through the wiping portion 16 by moving the spatula 80 in the groove extending direction X while maintaining the posture in which the spatula 80 extends in the groove extending direction X. When the concave surface 82 of the spatula 80 reaches the curved inner side surface 12*a* of the wiping portion 16, the spatula 80 is later pulled out of the groove 11 so that the concave surface 82 of the spatula 80 is made to follow the curved inner side surface 12*a*. In order to realize this operation, the spatula 80 is linearly moved substantially parallel to the longitudinal direction of the spatula 80 while the spatula 80 is rotated around the center of the curved inner side surface 12*a*. By combining the two motions, the spatula 80 can be pulled out of the groove 11 along the curved inner side surface 12*a*. The relief portion 17 continues from the wiping portion 16, the groove width of the relief portion 17 is wider than that of the wiping portion 16, and the end of the relief portion 17 is also open to the side surface of the sheet support jig 7. For this reason, even if the spatula 80 moves backward in the groove 11 while performing the combined motion of the rotational motion and the linear motion, the spatula 80 can be prevented from interfering with the sheet support jig 7.

In the wiping portion 16, the groove width Wmin is smaller by a minute amount ds than the sum of the plate thickness s of the tip 81 of the spatula 80 and the thickness 2p of two sheets. The tip 81 of the spatula 80 is surrounded by the V-shaped sheet 96 when passing through the wiping portion 16. The minute amount ds is a value that is large enough to apply pressure from the sheet support jig 7 through the sheet 96 to the tip 81 of the spatula 80 that passes through the wiping portion 16, and is small enough to allow passage. Exemplary and non-limiting values of ds are minus 5 mm to 5 mm. More preferably, ds is minus 3 mm to 3 mm, although any desired value of ds may be utilized.

By moving the spatula 80 in this way, the viscous material 95 attached to the convex surface 83 can be wiped off with the sheet 96 at the wiping portion 16. Therefore, labor of the work incidental to the application of the viscous material 95 can be saved.

Since the tip 81 of the spatula 80 is formed in a curved thin plate shape, even if the spatula 80 is moved in the groove extending direction X while keeping the posture of the spatula 80 in parallel with the groove extending direction X, the spatula 80 cannot pass through the wiping portion 16 or the viscous material 95 remains on the convex surface 83 because pressure cannot be applied from the wiping portion to the entire area of the convex surface 83.

On the other hand, in the present embodiment, since the inner side surface at the wiping portion 16 is a curved inner side surface that curves with the same curvature as the concave surface 82 of the spatula 80, and the concave surface is moved so as to follow the inner side surface, the entire convex surface 83 of the tip 81 sequentially passes through the portion having the narrowest groove width in the wiping portion 16. Therefore, pressure can be applied to the entire convex surface 83 from the wiping portion, and the viscous material 95 attached to the convex surface 83 can be wiped off well.

When wiping is performed once in this way, the roller actuator 5 is actuated, and the sheet 96 with the viscous material 95 in the work area 99 is wound around the take-up roller 4 to form the downstream roll 96*b*. A clean sheet is sent out from the upstream roll 96*a* to the work area 99. Thus, the groove 11 of the sheet support jig 7 is covered with the clean sheet 96, and preparation for the next wiping work is completed.

(Modification)

Although the embodiment has been described, the above configuration is merely an example, and can be appropriately changed, deleted, and/or added within the scope of the present invention.

The wiping portion 16 has a pair of curved inner side surfaces and has the same radius of curvature, but the radius of curvature may be different. As a result, the wiping can be performed corresponding to two spatulas 80 having different shapes of the tip 81. Further, only one of the inner side surfaces 12 and 13 in the wiping portion 16 may constitute the curved inner side surfaces 12*a* and 13*a*.

The wiping device 1 may be configured to perform a shaping. In this case, as an example, the shaping and the wiping are performed alternately.

The moving mechanism 9 is described as a robot including a robot arm 26 and moving actuators 27 which are exemplary implementation of an actuator. However, in place of or in addition to the actuators for robot/robot arm 26, other actuators may be utilized including any desired hydraulic, pneumatic, electric or mechanical actuator, such as a mechanical structure of a machining center or parallel mechanism robot, including but not limited to rotating and linear motors. Implementing any of these actuators to move the spatula 80 may be readily implemented utilizing the teachings disclosed herein.

Obviously, numerous modifications and variations of the present invention are possible in light of the above teachings. It is therefore to be understood that within the scope of the appended claims, the invention may be practiced otherwise than as specifically described herein.

REFERENCE SIGNS LIST

1 viscous material wiping device
7 sheet support jig
8 spatula holding member
9 moving mechanism
10 sheet facing surface
11 groove
12, 13 inner side surface
12*a*, 13*a* curved inner side surface
15 receiving portion
16 wiping portion
17 relief portion
30 controller
80 spatula
81 tip
82 concave surface
83 convex surface
95 viscous material
96 sheet
X groove extending direction
Y groove width direction
Z normal direction

The invention claimed is:

1. A viscous material wiping device for wiping a viscous material attached to a tip of a spatula with a sheet, the viscous material wiping device comprising:
a spatula holder to hold the spatula;
a sheet support jig having a sheet facing surface which is to face a sheet, the sheet support jig including a receiving structure and a wiping structure in a groove extending direction, and the wiping structure includes a groove width smaller than a width of the receiving structure, the groove extending direction being a direction parallel to the sheet facing surface;
an actuator to move the spatula holder together with the spatula; and
circuitry configured to drive the actuator to:
position the spatula on an opposite side of the sheet supporting jig with respect to the sheet, in a posture that the tip of the spatula overlaps the groove when viewed in a normal direction of the sheet facing surface,
move the spatula in the normal direction so that the tip of the spatula is received in the receiving structure by pressing the sheet against the groove with the spatula, and
move the spatula in the groove extending direction so that the tip of the spatula passes through the wiping structure.

2. The viscous material wiping device according to claim 1, wherein:
the tip of the spatula includes a curved shape and includes a concave surface and a convex surface opposite to the concave surface;
at least one of a pair of inner side surfaces of the groove includes a curved inner side surface that is curved with substantially a same curvature as the concave surface when viewed in the normal direction; and
the circuitry is further configured to:
move the spatula in the normal direction so that the tip is received in the receiving structure in a posture in which the concave surface faces the inner side surface of the groove, and
when moving the spatula in the groove extending direction, after the concave surface starts to face the curved inner side surface, moves the spatula in the groove extending direction while rotationally moving the spatula so that the concave surface follows the curved inner side surface.

3. The viscous material wiping device according to claim 2, wherein the pair of inner side surfaces of the groove are inclined such that an angle with the sheet facing surface is an obtuse angle.

4. The viscous material wiping device according to claim 1, wherein the groove includes a relief structure continuous with the wiping structure in the groove extending direction, and the relief structure includes a larger groove width than that of the wiping structure.

5. The viscous material wiping device according to claim 1, wherein:
the groove of the wiping structure is substantially equal to an outer dimension of the tip of the spatula.

6. The viscous material wiping device according to claim 1, wherein:
the receiving structure and the wiping structure are continuous in the groove.

7. The viscous material wiping device according to claim 1, wherein:
the circuitry configured to drive the actuator is further configured to position the spatula on the opposite side of the sheet supporting jig with respect to the sheet, in a posture that the spatula extends parallel to the groove extending direction when viewed in the normal direction.

8. A viscous material wiping device for wiping a viscous material attached to a tip of a spatula with a sheet, the viscous material wiping device comprising:
a spatula holder to hold the spatula;
a sheet support jig having a sheet facing surface which is to face a sheet, the sheet support jig including a receiving structure and a wiping structure in a groove extending direction, and the wiping structure includes a groove width smaller than a width of the receiving structure, the groove extending direction being a direction parallel to the sheet facing surface;
an actuator to move the spatula holder together with the spatula; and
means for driving the actuator to:
position the spatula on an opposite side of the sheet supporting jig with respect to the sheet, in a posture that the spatula extends parallel to the groove extending direction and overlaps the groove when viewed in a normal direction of the sheet facing surface,
move the spatula in the normal direction so that the tip of the spatula is received in the receiving structure by pressing the sheet against the groove with the spatula, and
move the spatula in the groove extending direction so that the tip of the spatula passes through the wiping structure.

9. The viscous material wiping device according to claim 8, wherein:

the tip of the spatula includes a curved shape and includes a concave surface and a convex surface opposite to the concave surface;

at least one of a pair of inner side surfaces of the groove includes a curved inner side surface that is curved with substantially a same curvature as the concave surface when viewed in the normal direction; and the means for driving is further for:

move the spatula in the normal direction so that the tip is received in the receiving structure in a posture in which the concave surface faces the inner side surface of the groove, and when moving the spatula in the groove extending direction, after the concave surface starts to face the curved inner side surface, moves the spatula in the groove extending direction while rotationally moving the spatula so that the concave surface follows the curved inner side surface.

10. The viscous material wiping device according to claim 9, wherein the pair of inner side surfaces of the groove are inclined such that an angle with the sheet facing surface is an obtuse angle.

11. The viscous material wiping device according to claim 8, wherein the groove includes a relief structure continuous with the wiping structure in the groove extending direction, and the relief structure includes a larger groove width than that of the wiping structure.

12. The viscous material wiping device according to claim 8, wherein:

the groove of the wiping structure is substantially equal to an outer dimension of the tip of the spatula.

13. The viscous material wiping device according to claim 8, wherein:

the receiving structure and the wiping structure are continuous in the groove.

14. A viscous material wiping device for wiping a viscous material attached to a tip of a spatula with a sheet, the viscous material wiping device comprising:

a spatula holder to hold the spatula;

means for supporting a sheet facing surface including a groove which extends in a groove extending direction and includes a means for receiving and a means for wiping, the means for wiping including a width smaller than the means for receiving, the groove extending direction being a direction parallel to the sheet facing surface;

an actuator to move the spatula holder together with the spatula; and circuitry configured to drive the actuator to:

position the spatula on an opposite side of the means for supporting with respect to the sheet, in a posture that the tip of the spatula overlaps the means for receiving when viewed in a normal direction of the sheet facing surface, move the spatula in the normal direction so that the tip of the spatula is received in the means for receiving by pressing the sheet against the groove with the spatula, and move the spatula through the means for receiving and the means for wiping.

15. The viscous material wiping device according to claim 14, wherein:

the tip of the spatula includes a curved shape and includes a concave surface and a convex surface opposite to the concave surface;

at least one of a pair of inner side surfaces of the groove includes a curved inner side surface that is curved with substantially a same curvature as the concave surface when viewed in the normal direction; and the circuitry is further configured to:

move the spatula in the normal direction so that the tip is received in the means for receiving in a posture in which the concave surface faces the inner side surface of the groove, and when moving the spatula in the groove extending direction, after the concave surface starts to face the curved inner side surface, moves the spatula in the groove extending direction while rotationally moving the spatula so that the concave surface follows the curved inner side surface.

16. The viscous material wiping device according to claim 15, wherein the pair of inner side surfaces of the groove are inclined such that an angle with the sheet facing surface is an obtuse angle.

17. The viscous material wiping device according to claim 14, wherein the groove includes a means for providing relief continuous with the means for wiping structure in the groove extending direction, and the means for providing relief includes a larger groove width than that of the means for wiping.

18. The viscous material wiping device according to claim 14, wherein:

the groove of the means for wiping is substantially equal to an outer dimension of the tip of the spatula.

19. The viscous material wiping device according to claim 14, wherein:

the means for receiving and the means for wiping are continuous in the groove.

20. The viscous material wiping device according to claim 14, wherein:

the circuitry configured to drive the actuator is further configured to position the spatula on the opposite side of the means for supporting with respect to the sheet, in a posture that the spatula extends parallel to the means for receiving when viewed in the normal direction.

* * * * *